US011033092B2

(12) United States Patent
Prudente

(10) Patent No.: US 11,033,092 B2
(45) Date of Patent: Jun. 15, 2021

(54) BACKPACK

(71) Applicant: Paul Prudente, East Weymouth, MA (US)

(72) Inventor: Paul Prudente, East Weymouth, MA (US)

( * ) Notice: Subject to any disclaimer, the term of this patent is extended or adjusted under 35 U.S.C. 154(b) by 0 days.

(21) Appl. No.: 16/550,511

(22) Filed: Aug. 26, 2019

(65) Prior Publication Data

US 2021/0059387 A1 Mar. 4, 2021

(51) Int. Cl.
*A45F 3/04* (2006.01)
*A45F 4/02* (2006.01)
*A45C 9/00* (2006.01)

(52) U.S. Cl.
CPC ..... *A45F 3/047* (2013.01); *A45F 4/02* (2013.01); *A45C 2009/007* (2013.01); *A45F 2003/045* (2013.01)

(58) Field of Classification Search
CPC ..... A45C 5/045; A45C 2005/10
USPC ..... 224/627–659, 182, 668, 678–680, 249, 224/269; 62/371, 457.2, 457.7
See application file for complete search history.

(56) References Cited

U.S. PATENT DOCUMENTS 3,902,640 A 9/1975 Geiben
4,094,351 A * 6/1978 Catenaccio ..... A45C 3/00 224/609
4,673,117 A * 6/1987 Calton ..... A45C 11/20 224/148.3
5,361,955 A * 11/1994 Gregory ..... A45F 3/04 224/630
5,668,869 A * 9/1997 Zinno ..... H04M 1/05 379/446
6,131,780 A * 10/2000 Becker ..... A45F 3/04 224/148.6
6,505,762 B2 * 1/2003 Wilfer ..... A45F 3/04 206/314
6,729,519 B2 5/2004 Kestler
8,256,242 B1 * 9/2012 Evans ..... A45C 11/20 62/457.7
8,708,207 B2 * 4/2014 Wetzsteon ..... A45F 3/12 224/643
9,233,703 B2 1/2016 Kassab Arabo
2002/0176593 A1 11/2002 Magnusson
2005/0061844 A1 3/2005 Haro
2005/0284867 A1 12/2005 Sander
2007/0205234 A1 * 9/2007 Lessmann ..... A45F 4/02 224/155

(Continued)

FOREIGN PATENT DOCUMENTS

DE 20112899 10/2001

OTHER PUBLICATIONS

United Solutions, Amazon—Laundry Basket Shoulder Strap, https://www.amazon.com/United-So1utions-LN0330-Laundry-Shoulder/dp/BOOKL9HK76, Mar. 2015.

*Primary Examiner* — Scott T McNurlen
(74) *Attorney, Agent, or Firm* — Lambert Shortell & Connaughton; David J. Connaughton, Jr.; Justin P. Tinger

(57) ABSTRACT

A hard-sided backpack is provided having shoulder straps allowing the backpack to be carried on both shoulders of a user. The hard-sided backpack may have multiple features to enhance versatility and operation, including an insulated liner for operation as a cooler, a speaker to provide entertainment, a rigid cover for use as a seat, and the like.

18 Claims, 8 Drawing Sheets

(56) References Cited

U.S. PATENT DOCUMENTS

| | | | | |
|---|---|---|---|---|
| 2010/0147918 | A1* | 6/2010 | Hensley | B62J 9/20 224/600 |
| 2012/0180184 | A1* | 7/2012 | Crye | A45F 3/14 2/69 |
| 2016/0040958 | A1* | 2/2016 | Alcantra | A45F 3/06 224/182 |
| 2017/0079336 | A1* | 3/2017 | Hirschberg | H04M 1/72552 |
| 2018/0303213 | A1* | 10/2018 | Pusey | A45C 13/02 |

* cited by examiner

BACKPACK

BACKGROUND OF THE INVENTION

Field of the Invention

The present disclosure relates generally to backpacks. More particularly the present disclosure relates to a hard-sided backpack with shoulder straps to be carried on a user's back which can be used as a laundry basket, cooler, basket, and the like.

Description of Related Art

In high-density housing areas as well as colleges and boarding schools, many tenants and housing unit owners do not have in-unit laundry, and so must travel to a distant laundromat facility to clean their clothes. This may be down a hall way, down stairs or an elevator, or across many city blocks to the nearest laundromat. Given the weight of a typical load of laundry, carrying a laundry basket can be quite a challenge and is inconvenient.

Moreover, the process of doing laundry can be very time consuming and boring, leaving those doing it waiting aimlessly. Thus, providing entertainment and activities to one who is doing laundry has great value.

Further still, for many, social events and activities often require carrying many items which, without a central storage area, become cumbersome. Common carrying solutions such as soft-sided backpacks and duffel bags often are insufficient for this job due to their soft sides and small size.

Therefore, what is needed is a device that may efficiently and easily carry laundry and other items.

SUMMARY OF THE INVENTION

The subject matter of this application may involve, in some cases, interrelated products, alternative solutions to a particular problem, and/or a plurality of different uses of a single system or article.

In one aspect, a hard-sided backpack is provided. The backpack is formed of a body which is made of a material which is hard enough to retain its shape against the force of gravity. This body is not a fabric material, but rather has hard sides, such as plastic, metal, composites, and the like. The body defines a plurality of front apertures on a front face, and a plurality of side apertures on each of a left and right side face. These apertures provide openings through the body to an inside of the body for ventilation and visual inspection of contents, as well as weight reduction. A cover is attached to a top of the body and is movable between an open and closed position. The cover allows access to the inside of the body through a top opening in an open position, and prevents access to the inside of the body through the top opening when in the closed position. Two shoulder straps are removably attached to a rear of the body, allowing the carrier to be carried as a backpack, one strap over each shoulder.

In another aspect, the hard-sided backpack may further comprise a speaker attached to the body. This speaker has a power source and a wireless signal receiver in communication with the speaker. The power source provides power to operate both the speaker and wireless signal receiver, allowing a user to play music wirelessly. This provides portable and self-contained entertainment options for the user.

In yet another aspect, the hard-sided backpack may further comprise an insulated liner positioned on an inside of the body. This insulated liner has a continuous base and side walls which define an interior space. The liner may be sized to have a cross section that fits approximately flush with an inner wall of the body, with some tolerance. This insulated liner may provide additional functionality to the backpack, allowing it to convert to, for example, a shoulder-carried cooler for storing ice and cooled beverages, food, and other items.

DETAILED DESCRIPTION

Figure 1:
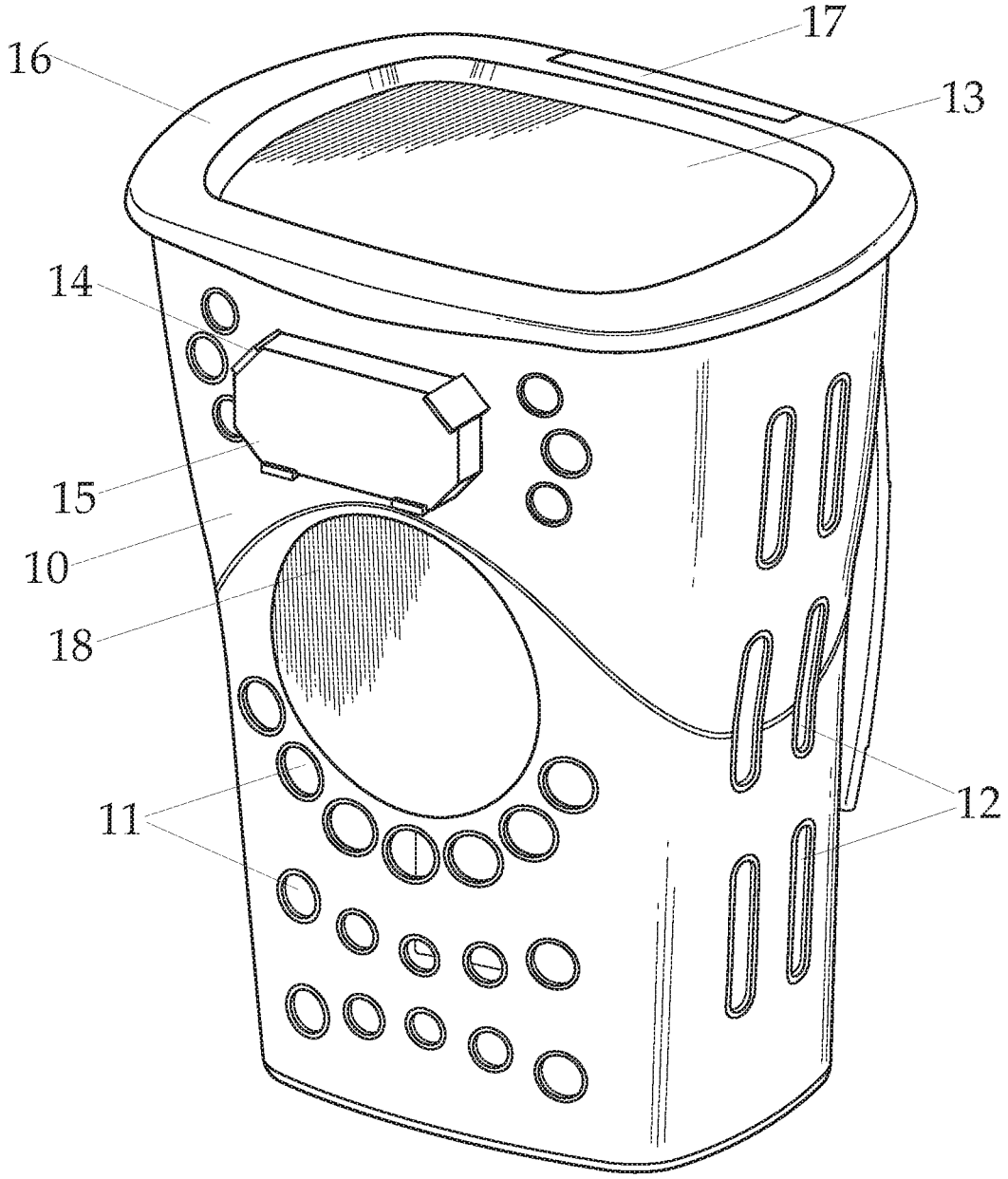
FIG. 1 provides a front perspective view of an embodiment of the hard-sided backpack.
Figure 2:
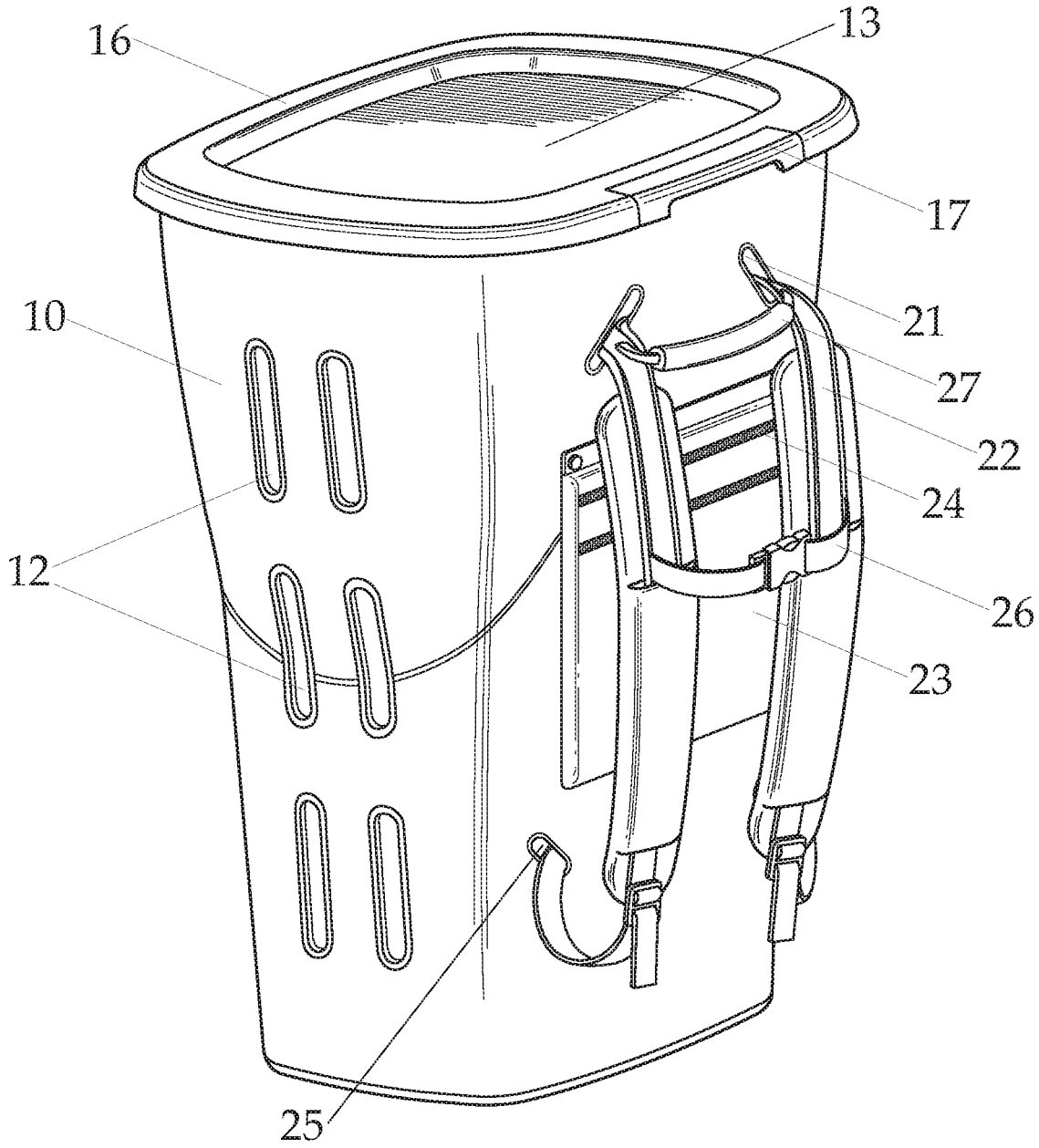
FIG. 2 provides a rear provides a perspective view of an embodiment of the hard-sided backpack.
Figure 3:
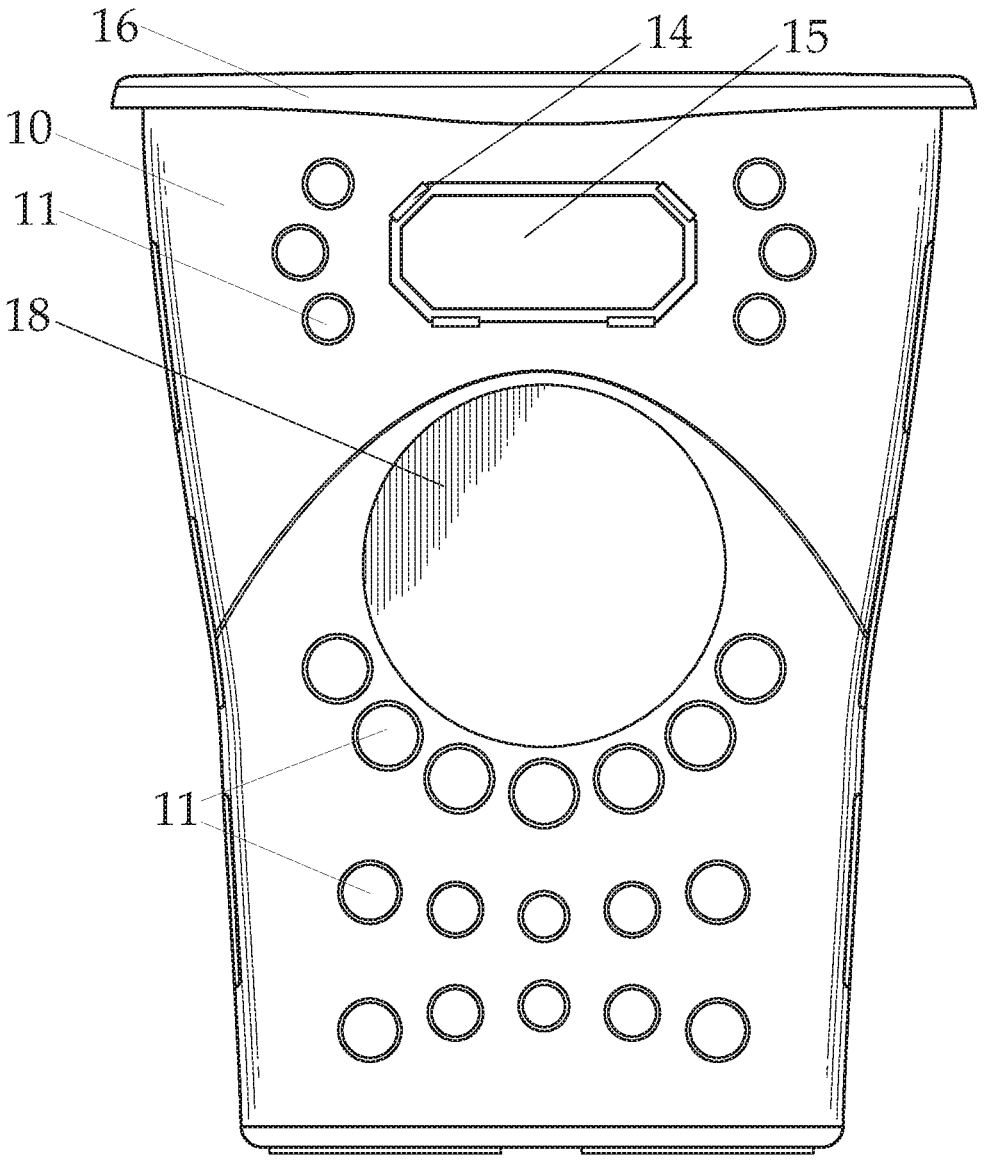
FIG. 3 provides a front view of the embodiment of FIG. 1.
Figure 4:
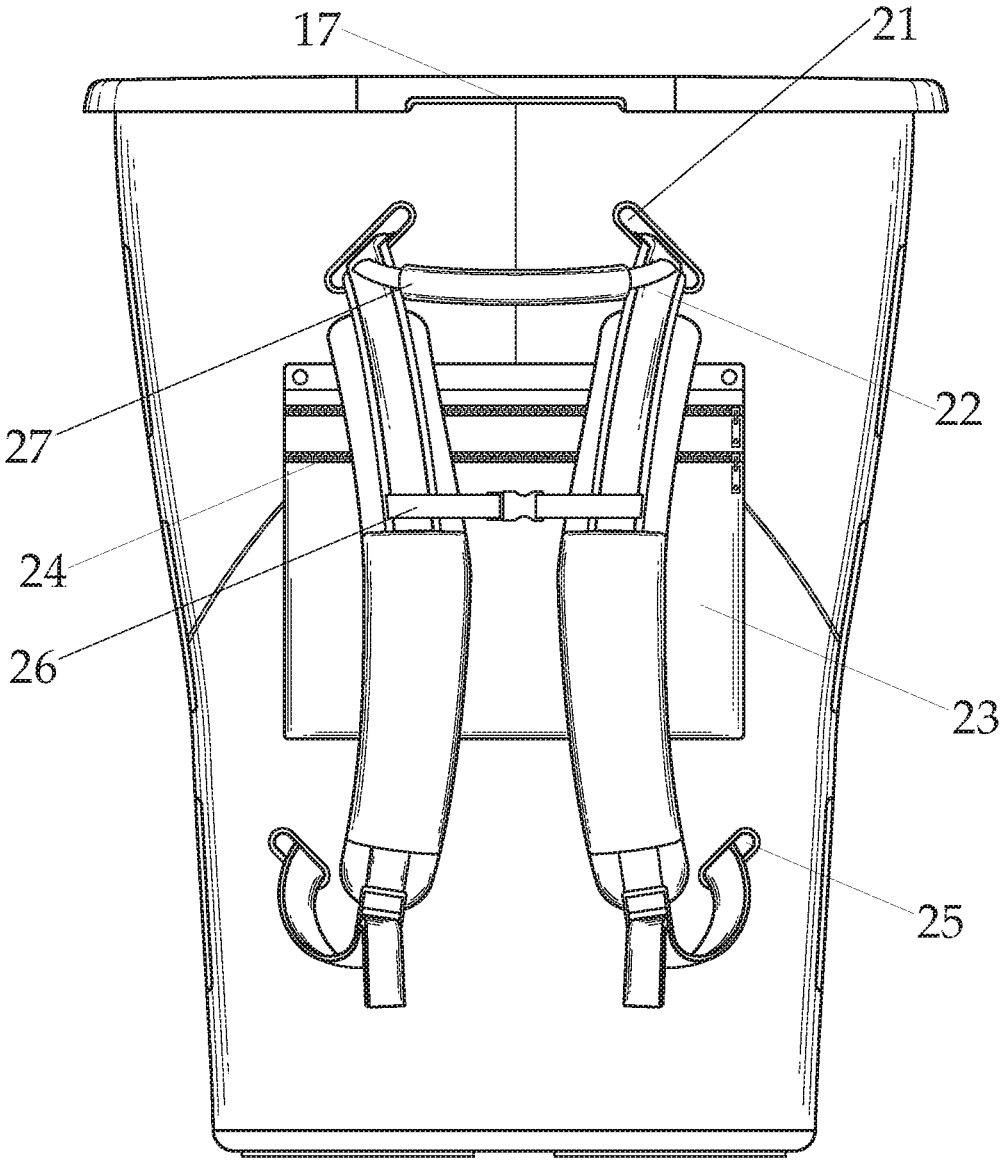
FIG. 4 provides a rear view of the embodiment of FIG. 1.
Figure 5:
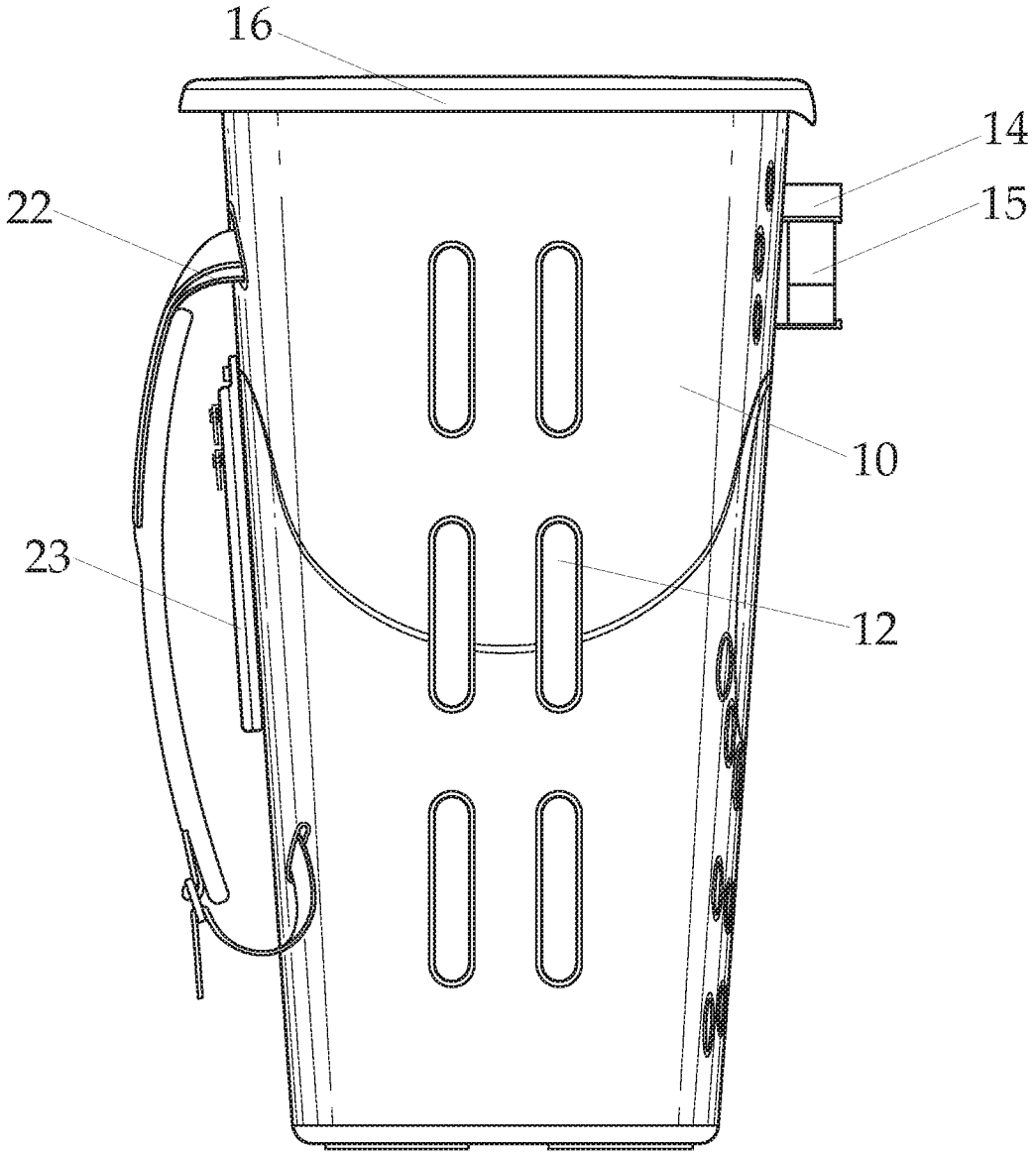
FIG. 5 provides a side view of the embodiment of FIG. 1.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a hard-sided backpack. The backpack is formed of a body which defines an inside cavity into which laundry, tools, toys, games, and any other small items can be stored. A cover movable between an open and closed position allows closing and opening of the inside of the body. In certain embodiments, one or a plurality of apertures may be formed into the body. In some embodiments, a plurality of apertures may be on both side faces of the body and a front face. In a further embodiment, the apertures may be sized to allow ventilation and visual inspection of the inside of the body. In another embodiment, the apertures may be sized to allow a clip to attach to the body through the aperture, allowing connection of additional items to the backpack. This clip may be able to frictionally engage the body through one or more of the plurality of apertures. Generally, the body is formed of a hard, non-fabric material which is resilient enough to allow it to retain its shape against the force of gravity and under normal operational uses (carrying laundry and other dense loads). Two shoulder straps are removably attached to a rear of the body. The shoulder straps provide a distinct advantage over the prior art in view of the hard-sided construction by allowing the hard-sided carrier to be carried over a user's shoulders. The backpack may further comprise a number of optional features to improve its functionality and advantages.

The hard-sided backpack disclosed herein allows for a user to efficiently carry a load over both shoulders, allowing a user to safely carry large loads. Moreover, the versatility of the device disclosed herein allows the same backpack to be used for many other purposes, such as carrying cooled items in an insulated liner, carrying picnic, beach, or outdoor supplies, and the like. Further still, the backpack may, in some embodiments, have a built-in speaker, which can allow a user to play music or other audio as entertainment when using the device. This solves many problems of the prior art including difficult-to-carry laundry baskets and other hard-sided carriers, providing a large and rugged carrying body for carrying many varied items, as well as having a cooler mode of operation for carrying chilled beverages, food, and the like on a user's back. This makes the cooler mode vastly more portable than traditional coolers which must be rolled, dragged, or carried by two people.

In one embodiment, the backpack may have a speaker attached to it. This speaker may allow a user to connect a device to it and play music. The speaker may have a wired and/or wireless connection functionality. The speaker may be permanently or removably connected to the body, and may be connected to the body of the backpack in any manner. In a particular embodiment, arms may extend outwardly from the body of the backpack and hold the speaker in place. In a particular embodiment, the arms may have a lip extending from their distal ends to help hold the speaker in place. In a further embodiment, the arms may have a ramp on the inner face extending from the distal end towards an end of the lip. This ramp structure allows the speaker to be urged into place by sliding over the ramps, bending the arms outwardly until the speaker reaches the end of the ramp, at which point the arms bend back to a resting position, holding the speaker in place.

In another embodiment, the backpack may have a zippered pocket attached to the rear of the body. The zippered pocket allows for storage of smaller items in a separate compartment, such as detergent, dryer sheets, and the like.

The cover may be connected to the body in any manner. For example, the cover may be hingedly connected, friction fit, snap fit, magnetically connected, and the like. In one embodiment, the cover may be formed as a flat surface. In another embodiment, the cover may have an inset surface from a top exterior of the cover. Certain insert surface embodiments of the cover may be advantageous for resting items on the cover, such as drinks, snacks, a phone, laundry detergent, and the like, on the inset area. This way, the ridge above the inset area provides a guide for placement and to prevent the item from accidentally falling off. In a particular embodiment, the cover may be formed of a resilient material such that it, and the body, may be used as a seat capable of supporting a person without damage or appreciable deformation.

In one embodiment, the backpack may further comprise a liner fitted within the inside of the body. In one embodiment, this liner may have continuous walls and a base and may allow for materials other than laundry to be stored within the backpack, such as liquids, ice, and the like. In a particular embodiment, the liner may be insulated, such as by having an insulation layer in or on one or more of the sidewalls and base or by being formed of an insulating material. The liner, in many embodiments, will be sized to fit flush or approximately flush with the inner walls of the backpack, such that it fits within substantially the entire volume of a cross section of the interior of the body. The liner may further have a drain opening in its base or one side wall. The drain opening may be blocked by a plug so as to allow draining of a liquid when the plug is not covering the opening, and prevent draining of the liquid when the plug is engaged in the opening.

In one embodiment, the backpack may have a predefined region which can receive a marker having a logo of, for example, a sports team, region, brand, or college. In one embodiment this region may be approximately circular. Connection of the marker to the backpack may be achieved in any manner, such as by adhesive, magnetic connection, painting, and the like.

In certain embodiments, the rear of the body may have, in addition to the shoulder straps, a spacer and/or waist strap. The spacer may be formed to extend away from the rear of the body to properly position the body in an ergonomic way for better shoulder carrying and weight distribution. The waist strap may be attached near a bottom of the body, so that a user may attach the backpack around their hips as well as shoulders.

Turning now to FIGS. 1-5, front, rear, side, and perspective views of an embodiment of the backpack are provided. The backpack is formed of a body 10. In this embodiment, the body 10 has a plurality of front apertures 11 and side apertures 12. The body 10 defines a cavity on the inside of the body into which laundry and other contents can be stored. A cover 16 covers a top opening to the inside cavity of the body. In this embodiment, the cover 16 is hingedly connected to the body by hinge 17, though it should be understood that any connection type, including removable is possible. An inset section 13 of the cover 16 provides a flat and stable surface on which items can rest. On a front face of the body 10 there is a circular flat recessed area 18. This area 18 may be used to connect a branded marking such as a sticker, magnet, painting, engraving and the like. A branded marking may allow a user to support a favorite team, university, brand, region, and the like.

Extending from a front of the body 10 are four arms 14. The arms 14 hold a speaker 15 to the body 10. Each arm 14 is flexible and has a lip at its distal end, such that one or more arms 14 can bend to release the speaker 15. The speaker 15, as noted above, may have a wired connector to allow direct connection to an audio source, or may have wireless connection functionality to connect to an audio source.

On a rear of the body 10 are the shoulder straps 22 which allow the backpack to be carried over a user's shoulders. The shoulder straps 22 include padded areas for comfort, as well as tightening clips which can adjust the length of the straps. 22. In this embodiment, the body 10 has top apertures 21 and bottom apertures 25 through which the straps 22 pass. The strap ends are anchored to the body 10 on an inside (not shown). This structure has been shown to provide the most comfort, strength, and optimal weight balance. The shoulder straps 22 include a chest strap 26 for optimizing carrying. Further, a handle 27 is positioned above the top of the shoulder straps and can provide a secondary mode of carrying the backpack. The handle 27 is positioned to provide optimal balance when carrying a load. Also on the rear of the body 10 is a zippered pocket 23. The pocket is accessible by zipper 24. Optionally, multiple zippers may provide access to separate pockets.

Figure 6:
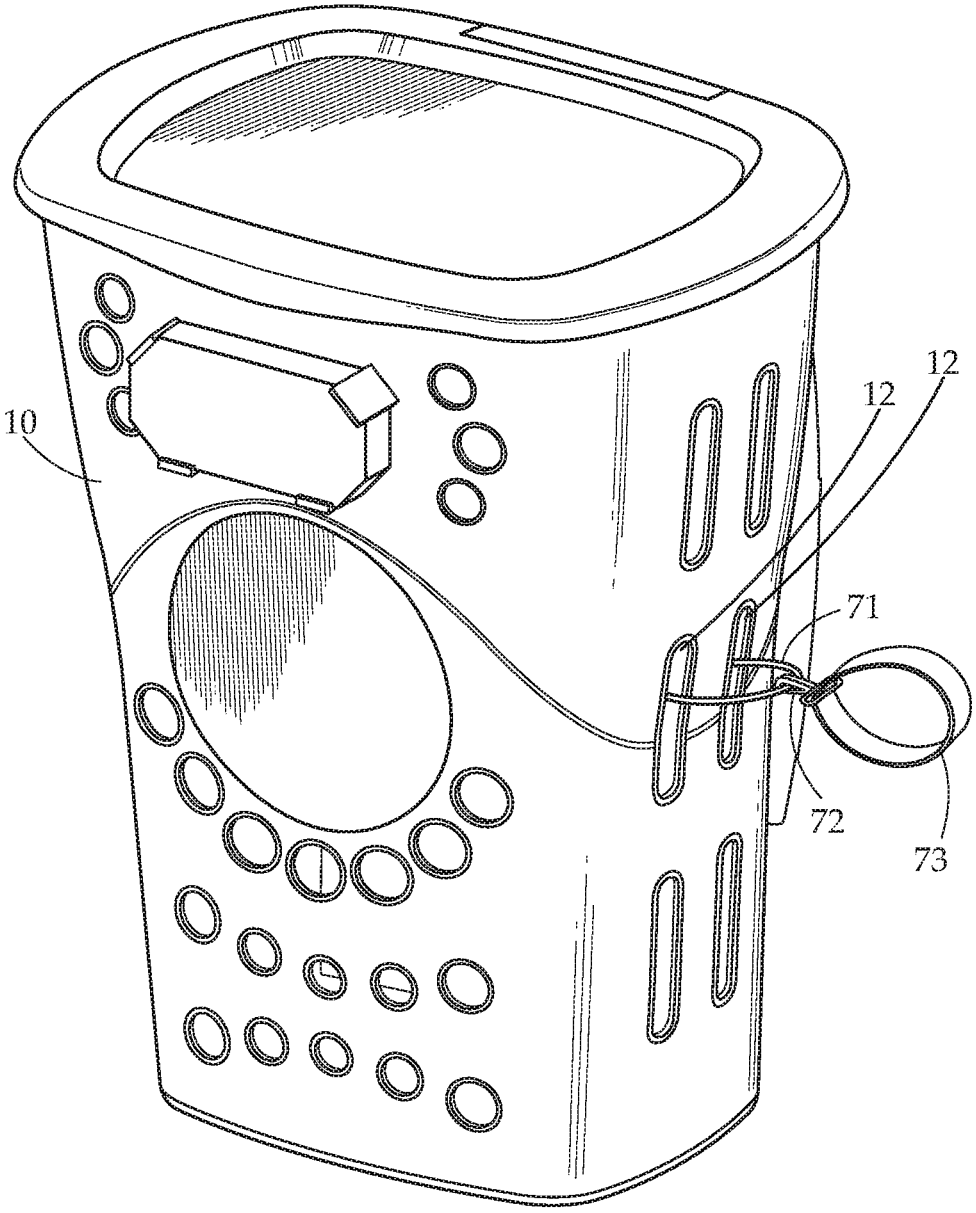
FIG. 6 provides a perspective view of another embodiment of the hard-sided backpack.
Figure 7:
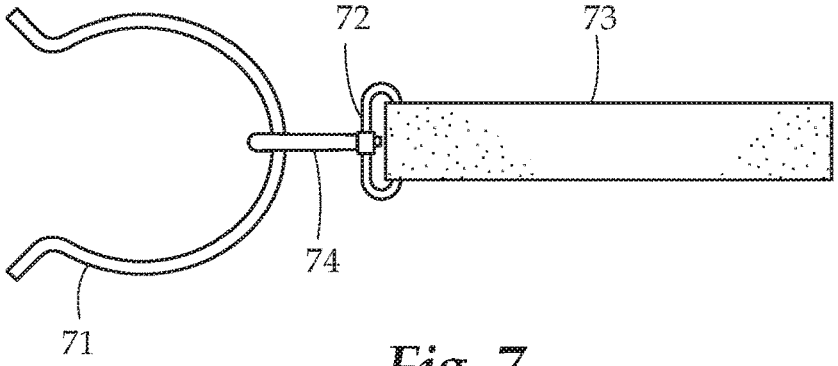
FIG. 7 provides a detail view of an embodiment of a clip for attachment to the hard-sided backpack.

FIG. 6 provides a perspective view of an embodiment of the hard-sided backpack having a side clip attached to the body via the side apertures. As can be seen, side apertures 12 allow passage through the body 10. A clip 72 has two arms 71 which pass through the apertures 12 and wrap around the body 10 between the apertures 12. Arms 71 are inwardly curving and are formed of a flexible material allowing them to flex and return to their original shape, thereby holding the clip 72 to the body 10. At a distal end of the arms 71 the arm shape bends back away from its curvature. This creates two ramps which facilitate the placement of the clip by allowing the arms 71 to be urged outward as force is applied to them against the body 10 near the apertures 12. A strap 73 connects to the clip 73 body. The strap 73 can be tightened and loosened as controlled by clasp 74. This strap 73 can be used to connect items to the hard-sided backpack body 10. For example, detergent or laundry supplies, an additional bag, towel, portable chair, or any other various items.

Figure 8:
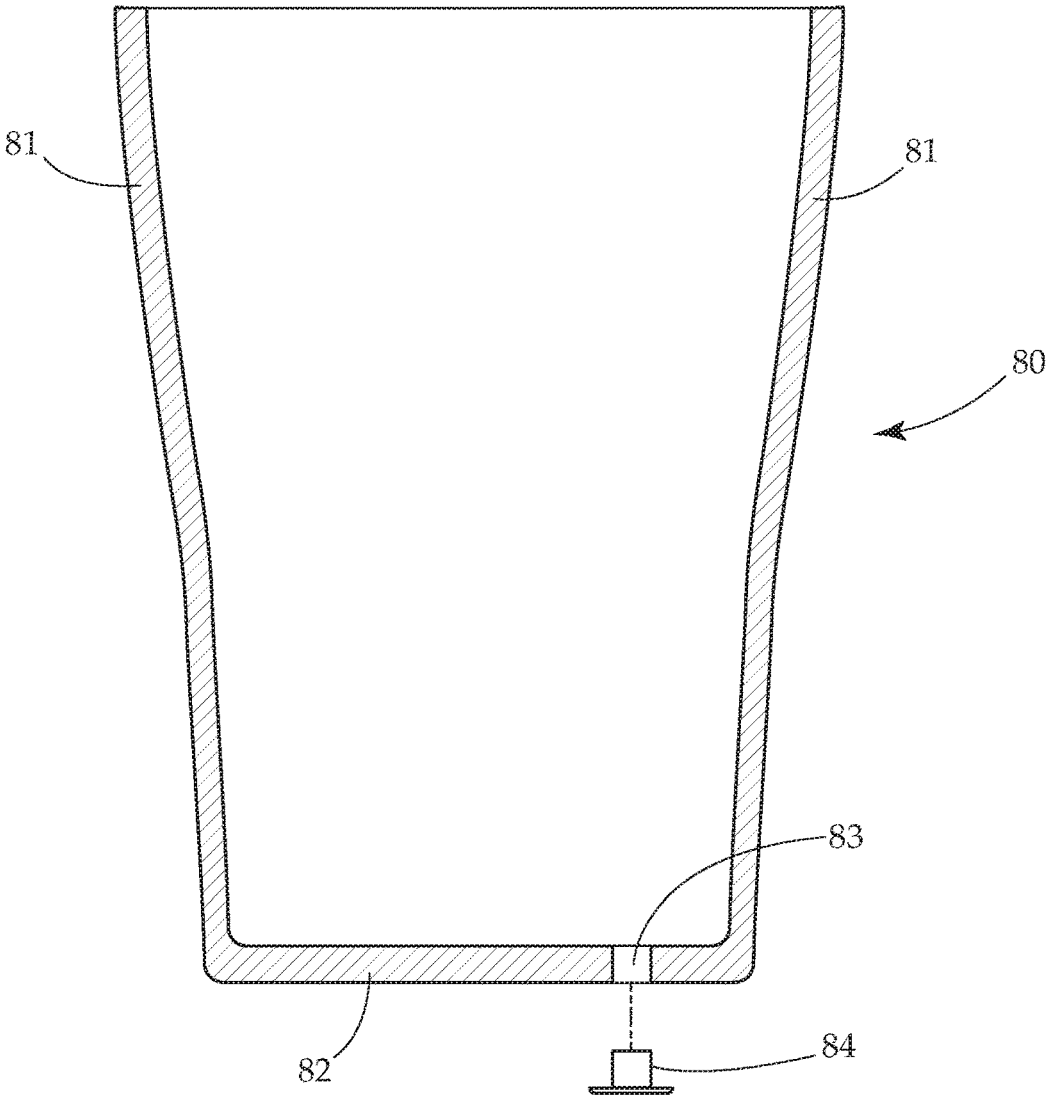
FIG. 8 provides a side cutaway view of an embodiment of an insulated liner for the hard-sided backpack.
Figure 9:
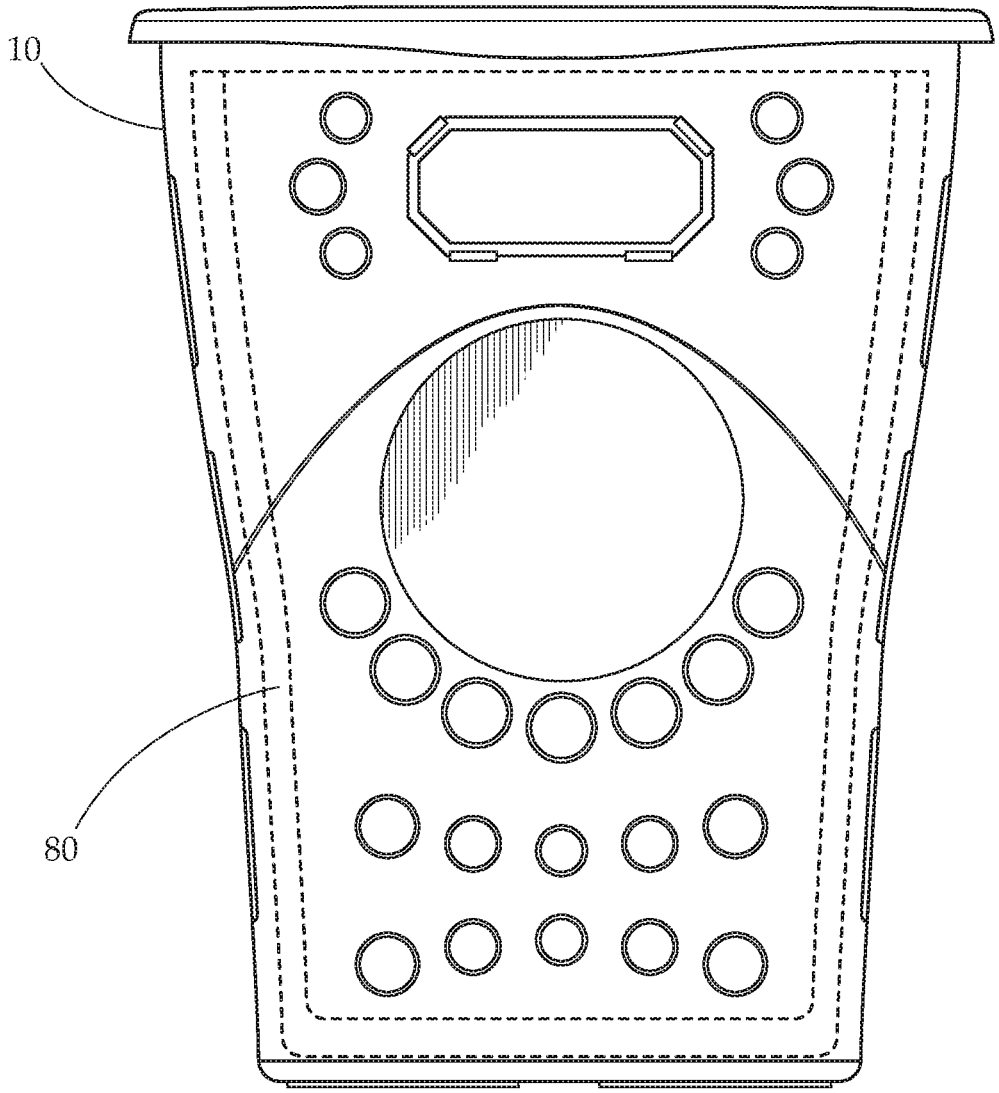
FIG. 9 provides a side view of an embodiment of the hard-sided backpack containing the insulated liner of FIG. 8.

FIGS. 8 and 9 provide views of the insulated liner both alone and positioned within the inside of the backpack. Liner 80 has continuous side walls 81 and base 82, as seen in the side cutaway view of FIG. 8. A drain 83 allows drainage of liquid from within the liner 80, and is stopped by a plug 84. This allows the liner to be used to store ice and chilled food, drink, or other items. Water can be drained from the liner through the drain 83. When used in combination with the hard-sided backpack, the liner can allow use both as, for example, a laundry basket, as well as a cooler and for liquid storage. While the insulated liner 80 is shown taking up much of the height of the body, in other embodiments, it may only take up part of the height of the body, thereby allowing a user to place other items in the body without being in the insulated liner. For example, the insulated liner may store chilled items in a part of the inside of the body, while the remainder of the body can be used for storage of non-chilled items, such as beach or outdoor equipment (towels, blankets, and the like), laundry, and so on. In such embodiments, a cover of the insulated liner may be provided. Insulation may be present in the side walls 81 and/or base 82. Any insulation may be used without straying from the scope of the invention, such as foam, rigid foam, air-gap, plastic with a low heat transfer coefficient, and the like. In a particular embodiment, the insulated liner 80 may be formed of a solid plastic. The plastic's inherent insulation abilities may then provide the required insulation for the insulated liner 80 without any special insulation layer.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A hard-sided backpack comprising:

a body, the body being formed of a material which retains its shape, the body defining an inside cavity, the body defining a plurality of front apertures on a front face, and a plurality of side apertures on each of a left and right side face the apertures operable to reduce a weight of the body;

a cover, the cover movable between an open and a closed position, the cover allowing access to an inside of the body in the open position and preventing access to the inside in the closed position;

two shoulder straps attached to a rear of the body;

wherein each of the two shoulder straps connects to the body at a top of each strap by passing through one of a plurality of top rear apertures in the body to connect to the body by being anchored to the inside of the body, a top portion of the strap passing into the body inside cavity;

wherein each of the two shoulder straps connects to the body at a bottom of each strap by passing through one of a plurality of bottom rear apertures in the body to connect to the body by being anchored to the inside of the body, a bottom portion of the strap passing into the body inside cavity; and an insulated liner positioned within the inside cavity of the body, the insulated liner having a continuous base and sidewalls which define an interior of the insulated liner.

2. The hard-sided backpack of claim 1 further comprising a speaker attached to the body, the speaker comprising a power source and a wireless receiver both in communication with the speaker.

3. The hard-sided backpack of claim 2 wherein the speaker is attached to the body by a plurality of arms, each of the plurality of arms protruding outwardly from the body, and having a lip at a distal end, each of the plurality of arms engaged with the speaker.

4. The hard-sided backpack of claim 1 further comprising a zippered pocket attached to the rear of the body.

5. The hard-sided backpack of claim 1 wherein the cover defines a flat surface.

6. The hard-sided backpack of claim 1 wherein the cover has a hinged connection to the body.

7. The hard-sided backpack of claim 1 wherein at least one of the base and sidewalls of the insulated liner comprise an insulation layer.

8. The hard-sided backpack of claim 1 wherein each of the base and sidewalls of the insulated liner comprise an insulation layer.

9. The hard-sided backpack of claim 1 wherein at least one of the base and sidewalls of the insulated liner comprises an opening allowing draining of a fluid, and a plug sealing the opening when engaged in the opening.

10. The hard-sided backpack of claim 1 wherein the insulated liner is sized to fit within substantially the entire volume of the interior of the body.

11. The hard-sided backpack of claim 1 further comprising a clip passing through at least one of the side apertures of the body and engaged with the body, the clip allowing attachment of additional components to the hard-sided backpack.

12. The hard-sided backpack of claim 11 wherein the clip has a snap connection to frictionally engage the body through the one of the plurality of side apertures.

13. The hard-sided backpack of claim 11 wherein the clip is a flexible strap.

14. The hard-sided backpack of claim 1 wherein the cover is operable as a seat.

15. The hard-sided backpack of claim 1 wherein the front of the body defines a circular region which may receive a marker having a logo of a sports team or college.

16. The hard-sided backpack of claim 1 further comprising a spacer on a rear of the body, the spacer operable to space the body away from a user when the user is carrying the hard-sided backpack.

17. The hard-sided backpack of claim 1 further comprising a waist strap attached to a rear of the body.

18. A hard-sided backpack comprising:

a body, the body being formed of a material which retains its shape, the body defining an inside cavity and defining a plurality of front apertures on a front face, and a plurality of side apertures on each of a left and right side face the apertures operable to reduce a weight of the body;

a cover, the cover movable between an open and a closed position, the cover allowing access to an inside of the body in the open position and preventing access to the inside in the closed position;

a clip passing through at least one of the side apertures into the inside cavity of the body and engaged with the body, the clip allowing attachment of additional components to the hard-sided backpack;

an insulated liner positioned within the inside cavity of the body, the insulated liner having a continuous base and sidewalls which define an interior of the insulated liner; and two shoulder straps attached to a rear of the body.

* * * * *